United States Patent [19]

Eckhardt et al.

[11] Patent Number: 4,609,977

[45] Date of Patent: Sep. 2, 1986

[54] INCANDESCENT LAMP-BASE ASSEMBLY, PARTICULARLY FOR AN AUTOMOTIVE-TYPE HALOGEN INCANDESCENT LAMP

[75] Inventors: Fritz Eckhardt, Dettingen; Peter Helbig, Sontheim/Brenz; Walter Schönherr, Giengen-Hüben, all of Fed. Rep. of Germany

[73] Assignee: Patent-Treuhand-Gesellschaft für elektrische Glühlampen mbH, Munich, Fed. Rep. of Germany

[21] Appl. No.: 768,043

[22] Filed: Aug. 22, 1985

[30] Foreign Application Priority Data

Aug. 24, 1984 [DE] Fed. Rep. of Germany ..... 3431191
Aug. 7, 1985 [DE] Fed. Rep. of Germany ..... 3528399

[51] Int. Cl.[4] ..... F21V 29/00
[52] U.S. Cl. ..... 362/267; 362/61
[58] Field of Search ..... 362/267, 61, 80; 313/318

[56] References Cited

U.S. PATENT DOCUMENTS 4,243,907 1/1981 Kohl et al. ..... 313/318
4,384,236 5/1983 Hellwig et al. ..... 313/318
4,492,893 1/1985 Steiner et al. ..... 313/318
4,504,763 3/1985 Nakanishi et al. ..... 313/318
4,528,619 7/1985 Dolan et al. ..... 362/267
4,547,838 10/1985 Nakimizu ..... 362/267

FOREIGN PATENT DOCUMENTS 699400 12/1965 Italy ..... 362/267

*Primary Examiner*—E. Rollins Cross
*Attorney, Agent, or Firm*—Frishauf, Holtz, Goodman & Woodward

[57] ABSTRACT

To provide an easily made electrical connection between current leads (3, 23) extending from a halogen incandescent lamp (1, 21) through a base cup (7, 27) and connecting blades (10, 30), an attachment element (12, 32) is formed with a wall portion (12*a*, 32*a*) which, together with the bottom wall (7*a*) of the base cup defines a chamber, in which chamber the electrical connections between the terminal prongs (10, 30) and the current supply leads (3, 23) are formed. Openings (8) through which the current supply leads extend are sealed, for example by melting down plastic material of which the base cup (7, 27) is formed, or by pouring a resin, for example a silicone rubber resin, in the chamber (13, 33) after having made the connection, to fill the openings, seal the openings, and coat the electrical connections which, typically, are made by welding. The chamber can be entirely filled with resin, if desired.

21 Claims, 4 Drawing Figures

INCANDESCENT LAMP-BASE ASSEMBLY, PARTICULARLY FOR AN AUTOMOTIVE-TYPE HALOGEN INCANDESCENT LAMP

The present invention relates to an electric lamp-base assembly, and more particularly to a halogen incandescent lamp for use in combination with an automotive-type headlight reflector.

BACKGROUND

Halogen incandescent lamps have substantial advantages, particularly when used as automotive headlights; their light is bright and intense. Halogen incandescent lamps, thus, are used increasingly. In such lamps, a lamp bulb is formed with a lamp press through which current supply leads are carried. A holder element, typically made of metal, is secured to the lamp bulb, e.g. to the lamp press. The metal holder element, in turn, is attached to a cup-shaped base sleeve which has a bottom wall. The base sleeve is used as a carrier for the base terminals to which electrical connection can be made to supply the filament within the lamp with electrical energy. The base sleeve, of course, must be apertured to permit the current supply leads and/or the terminal elements to be passed therethrough and retained therein.

Lamps of this type are described, for example, in German Utility Model Publication DE-GM No. 82 01 526. Such lamps are suitable for combination with an automotive-type headlight reflector and are arranged to be sealingly received therein, to provide a tight, sealed connection with the reflector. The plastic base sleeve, in order to obtain a tight seal, is formed with at least one groove in which a sealing ring can be inserted, for example an O-ring. The sealing ring is tightly received within an opening at the neck of the reflector, typically at an apex thereof. Current supply leads for the lamps are carried through the bottom of the base sleeve and through openings in the base contact terminals, which are in alignment with the openings in the base sleeve. The current supply leads from the lamp are welded to blade-type terminal prongs. The weld connection and the overall connection is so arranged that a hermetic seal of the bottom wall of the base sleeve with the lamp base is obtained.

It has been found that the welding process is expensive and complex, due to the close proximity of the plastic material forming the base cup or sleeve. Accordingly, it has been tried to find a construction which permits a simpler way of sealing the lamp base and lamp assembly with respect to moisture and other contaminants, and to protect the connections between the terminal prongs and the lamp current supply leads with respect to mechanical and ambient, typically atmospheric conditions, and deteriorating influences thereof.

THE INVENTION

It is an object to improve an incandescent lamp-base assembly, and more particularly a halogen incandescent lamp-base assembly suitable for use with an automotive-type headlight reflector, which is easily made, permits ready connection between terminals prongs and electrical current supply leads from the bulb, and which provides a tight seal.

Briefly, an attachment element of insulating material, typically plastic material, is formed which has a wall portion formed with openings through which the terminal prongs are passed. The terminal prongs can be fitted and sealingly retained in the attachment element. The wall portion of the attachment element is positioned to fit parallel to, but spaced from the bottom wall of the plastic connecting cup or sleeve of the lamp base to define therewith a chamber. The electrical contacts between the terminal prongs and the current leads from the lamp are made within the chamber, thus permitting accessibility while spacing the terminal connections themselves from the plastic elements.

In accordance with a feature of the invention, the chamber and any surrounding openings through which the terminal prongs and/or the lamp leads have passed, is filled with or retains a water-proof resin filler, for example silicone-type resin, or silicone rubber, to insure a complete seal of the electrical connecting elements through any openings, and to seal the chamber, airtightly. If desired, the attachment element may be formed with a sealable closing wall portion which is inserted after the electrical connections between the terminal prongs and the current leads have been made, typically by welding. The chamber may then be filled with the respective resin and the cover added, retained by an interference fit and the adhesive action of the resin.

The arrangement has the advantage that the ends of the connecting prongs can be readily, unremovably, retained, in one of the wall portions. The through-opening, or openings, in the base plate of the socket sleeve is required only to carry the current leads from the lamp therethrough. The diameter can be so selected that it is only very slightly larger than the current leads themselves, so that it is a simple matter to seal these openings, after having introduced the current leads, for example by the aforementioned resin. The closing material, further, may be formed by the material of the base sleeve and/or the attachment element themselves. This material can be provided, prior to insertion of the current leads by a collar or the like formed thereon, which, later on, is melted down by inductive and/or ultrasonic heating. In mass production conditions, it may be easier, however, to seal the openings with a pourable resin, such as silicone resin.

The base sleeve typically is made of a high temperature resistant plastic material, of sufficient temperature resistance to be capable of accepting heat which is radiated from the lamp bulb itself. The attachment element, being much farther removed from the lamp, can be made of more inexpensive plastic material. The connection of the two elements, after connecting the electrical prongs and leads, can be sealed by ultrasonic heating. The elements can be formed, prior to attachment, with interengaging projection-and-recess arrangements, such as nipples fitting into grooves or notches, so that, when the sleeve and attachment elements are plastic-welded together, an unremovable, tightly retained, sealed and essentially unitary structure is obtained.

DRAWINGS

DETAILED DESCRIPTION

Figure 1:
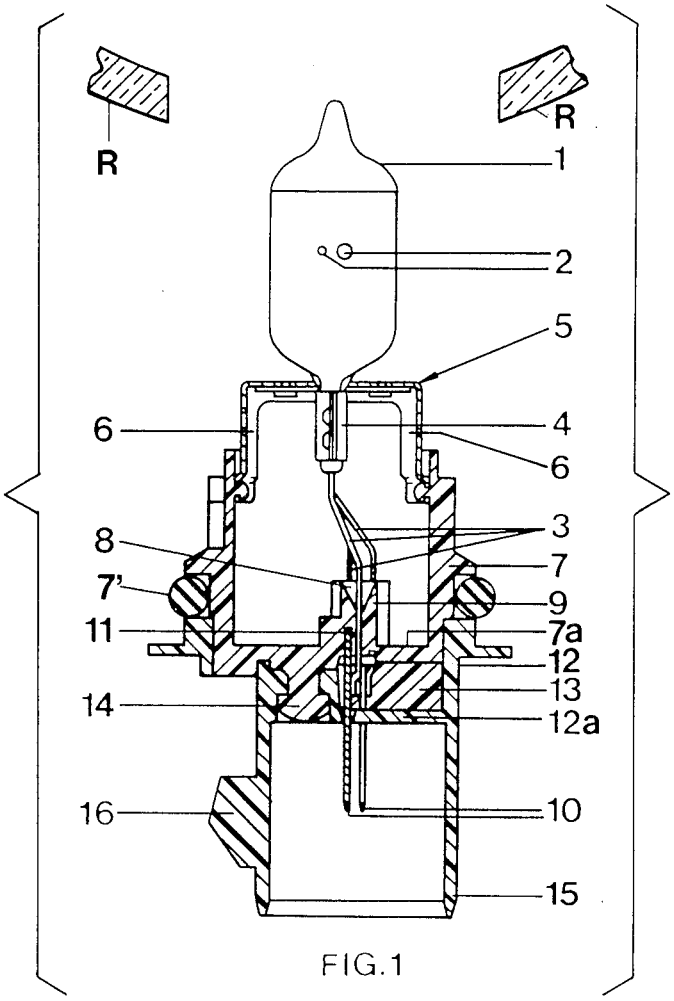
FIG. 1 is a schematic sectional side view through the base for a halogen incandescent lamp, shown only schematically, in which, further, a fragmentary representation of a reflector is shown, illustrated in exploded form with respect to the lamp and its base.
Figure 2:
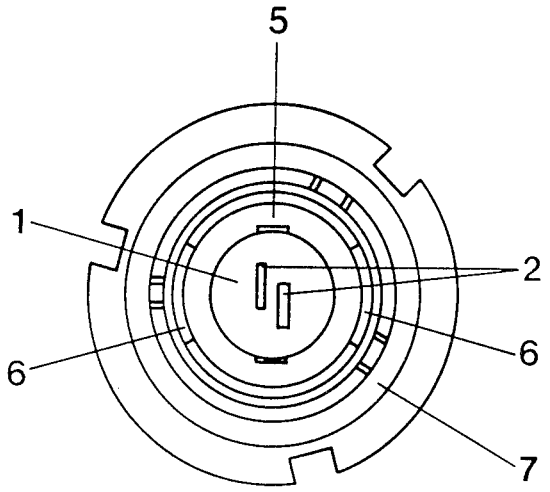
FIG. 2 is a top view of the lamp of FIG. 1.

The lamp illustrated in the drawings is particularly intended for assembly with a reflector of an automotive headlight, shown only schematically at R in FIG. 1. The lamp-base assembly is adapted to be sealingly received in the neck portion of the reflector R.

The lamp has a single-ended bulb 1 (FIG. 1), 21 (FIG. 4), and retains one or two filaments 2, 22. Current supply leads 3, 23 are sealed into the end press or pinch seal of the bulb. The lamp 1, 21 is a halogen incandescent lamp which includes an inert gas with a halogen additive. The lamp bulb 1, 21 is surrounded by a metal holder 4, 24, fitted about the lamp press or pinch seal, and forming part of a holder assembly 5, 25. The holder 4, 24 has projecting leg portions 6, 26 which are securely connected with a cup-shaped base sleeve 7, 27. The cup-shaped base sleeve 7, 27 is made of plastic material.

The connection between the metal legs 6, 26 and the cup-shaped base sleeve 7, 27 is formed by a ridge or rib, formed at the lower edge of the legs 6, 26 and openings within the legs 6, 26. Upon high-frequency heating of the plastic material of the cup-shaped sleeve, the two elements 6, 7; 26, 27 will be securely joined by flowing of the plastic socket material around the ridge or rib and into the openings of the legs 6, 26. A reliable and tight and secure connection is thereby obtained.

The cup-shaped base sleeve 7, 27 has an open end portion which faces the lamp bulb 1, 21. Preferably, it is made of highly heat-resistant plastic material. In operation, the lamp may reach temperatures of up to 240° C. A suitable plastic material is polyphenylenesulfide, preferably reinforced with glass fibers and mineral fillers.

The cup-shaped base sleeve 7, 27 has a bottom wall 7*a*. The bottom wall 7*a* has through-openings 8 (not shown in FIG. 4) to permit passage of the current supply leads 3, 23 therethrough. The diameter of the openings 8 is only slightly greater than the diameter of the current supply leads 3, 23—typically round wires—which can be readily threaded therethrough by forming funnel-like openings 9 about the upper ends of the opening 8—see FIG. 1.

The openings 8 are closed by introducing a flowable resin around the current supply leads to seal them within the openings. A suitable resin is a silicone-based resin.

Figure 3:
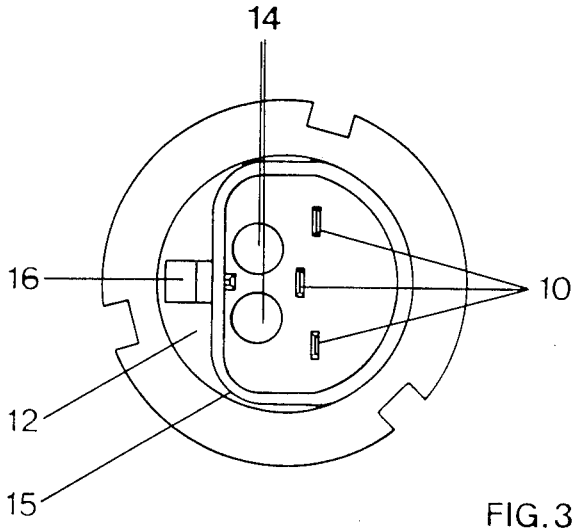
FIG. 3 is a bottom view of the lamp and its base.

The connecting prongs 10 of the lamp—see FIG. 1—are of blade construction, that is, are formed as connecting blades. They are retained in slots, forming blind holes 11 at the back side of the bottom plate 7*a* of the sleeve 7. The slots 11 are dimensioned to receive the prongs 10 without play, and, for example, by an interference fit. The prongs 10 and the current supply leads 3 are welded together at the bottom side—with respect to FIG. 1—of the bottom wall 7*a*. Two, each, of four current supply leads 3 from the lamp are connected to one terminal, to form a ground or common terminal, the other remaining two leads each are connected to a separate terminal—see FIG. 3.

The blades 10 may be formed with suitable projecting points or barbs to prevent pull-out and to form an extra strain relief with respect to the wires 3, as well known.

In accordance with the present invention, and to provide a tight seal of the cup-shaped sleeve 7, and the electrical terminals therefrom, as well as to protect the connections between the prongs 10 and the connecting leads 3, an attachment element 12 (FIG. 1), 32 (FIG. 4), is secured to the cup-shaped sleeve 7. The attachment element 12 (FIG. 1) is placed on the sleeve 7 from the bottom, and so constructed that the connecting locations between the current supply leads 3 and the terminal prongs 10 will be located within a closed chamber 13. The attachment element 12, to this end, is formed with a top wall 12*a*, so that the chamber will be defined between the bottom wall 7*a* of the cup-shaped sleeve 7 and the top wall 12*a* of the attachment element 12. After connecting the current supply leads 3 to the prongs 10—for example by welding—a resin is poured into the chamber 13, which resin will additionally penetrate through the openings 8, as well as through-openings formed in the top wall 12*a* to permit passage of the prongs 10. Thus, not only will the chamber 13 be filled, but all cracks and remaining openings through which electrical connections have passed will be securely sealed.

The base sleeve 7 and the attachment element 12 are secured together by a plastic rivet connection. The base sleeve 7, before assembly, is formed with one or more projecting nipples 14, fitting through suitable openings, matching the location of the nipples 14, and formed in the top wall 12*a* of the attachment element 12. After assembly, the nipples 14 are deformed, for example by an ultrasonic engagement element, so that the nipples will tightly grip around the top wall 12*a* of the attachment element 12 and form a rivet connection—see FIG. 1.

The attachment element 12 preferably is made of plastic material. This material need not be so expensive, and heat-resistant as that of the sleeve 7, since the element 12 will not be exposed to such high temperatures. This has the advantage that the lamp—entirely apart from the substantial simplification in manufacture and sealing of the weld connections—can be made less expensively since the most expensive material is used only at those locations where it is actually needed.

Figure 4:
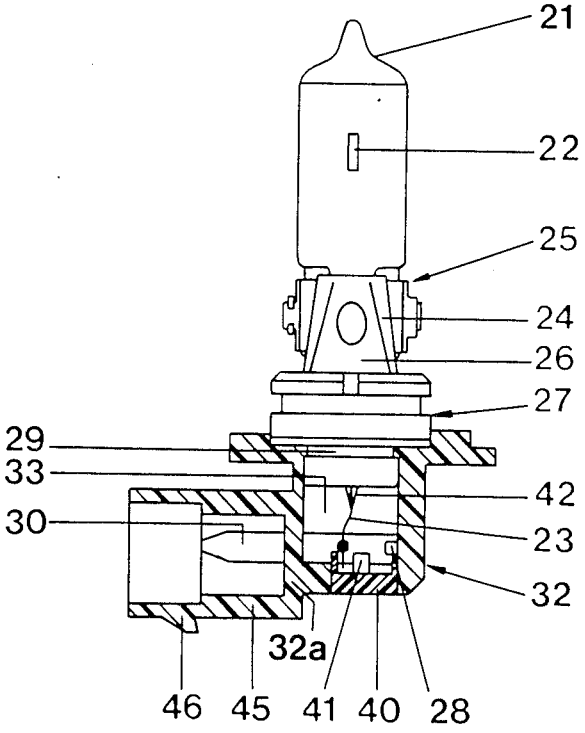
FIG. 4 is a side view, partly in section, illustrating another base-attachment assembly arrangement, in which only the connecting assembly is shown in detail, since the remainder of the lamp and base are identical to that illustrated in FIG. 1.

Embodiment of FIG. 4: Some lamps desirably have right-angle connections of the attachment prongs. FIG. 4 illustrates an arrangement in which the attachment element 32 is cup-shaped, and the terminal blades 30 are carried out from the attachment element through a lateral wall portion thereof. The ends of the terminal prongs 30, at their connecting portion with the connection leads from the lamp, are located within a chamber 33. They are retained in the chamber 33 by a projection 28 formed on the wall portion of the attachment element 32. The projection 28 is located opposite openings formed in the attachment element 32 to permit passage of the blades 30 therethrough. The projection 28 may engage in a suitable groove or notch formed in the terminal prong 30.

In the embodiment of FIG. 1, the terminal prongs 10 are first seated in the slots 11 before the attachment element 12 is fitted thereover, being passed through suitable openings in the top wall 12*a*. In the embodiment of FIG. 4, however, the prongs 30 are first fitted through suitable openings in a wall 32*a* which, together with the bottom 12*a* (not specifically shown in FIG. 4) defines the chamber 33. In assembling the embodiment of FIG. 1, the current supply leads 3 can be welded to the prongs 10 before assembling the attachment 12 on the base sleeve 7. In the embodiment of FIG. 4, the attachment element 32, together with the prongs 30, is secured to the base sleeve 27 before the connection, for example by welding, of the current supply leads 23 with the terminal blades 30. The attachment element 32 is formed with projections, the material of which can flow into a circumferential groove 29 formed on the base sleeve 27.

The connecting element 32 is formed with an access opening to permit access to the chamber 33 to connect the current supply leads 23 from the lamp with the terminal blades 30. After welding the lamp leads 23 to the terminal blades, the access opening is closed by a cover 40.

In accordance with a preferred feature of the invention, the cover 40 is formed at its inner side with projections 41 which cooperate with a further groove or notch in the terminal blades 30. The terminal blades 30, thus, are securely retained within the chamber 33 with respect to stresses in axial direction as well as in transverse direction, so that the prongs 30 cannot be loosened if a connecting plug is placed thereon and, subsequently, removed.

The base is sealed by a collar 42 formed in the bores which pass through the base 27 of the bulb. After having passed the current connections 23 through the respective openings, the collar 42 is melted down to provide a tight seal engagement. Alternatively, any openings remaining, after passage of the current supply leads 23 and the terminal prongs 30, can be sealed by pouring silicone rubber, for example, or another suitable resin into the chamber 33. Such material has been omitted from the drawing in FIG. 4 for simplicity and ease of illustration.

In the embodiments of FIGS. 1 and 4, an extension sleeve 15, 45 is formed on the attachment elements 12, 32, and surrounding the connecting blades 10, 30. The sleeve 15, 45 is provided to permit, for example, a sealing boot, or bushing, and surrounding a connecting plug to be sealingly received. The base terminals 10, 30 are thus effectively protected against moisture and corrosion. Good electrical contact between the blades 10, 30 and a connecting plug is thereby insured. The base sleeve 7 can be sealed in the reflector R by an O-ring 7' (only shown in FIG. 1). A projection 16, 46 is provided on the sleeve extension of the attachment element 12, 32 to prevent inadvertent and undesired loosening of a plug connected to the lamp, and fitted over the sleeve-like extension 15, 45.

Various changes and modifications may be made, and features described in connection with one of the embodiments may be used with the other, within the scope of the inventive concept. For example, the resin within the chamber 13, 33 need not entirely fill the chamber; it is sufficient if the protective resin coats the connection, typically a weld connection, between the respective current supply leads 3, 23 and the prongs 10, 30 in the attachment element, to provide for environmental protection of the weld connection and to protect the weld connection against corrosive influences. After application, the initially flowable resin is cured, as well known.

We claim:

1. Incandescent lamp-base assembly, particularly for association with an automotive reflector (R) having a single-ended bulb (1, 21);

current leads (3, 23) extending from a pinch or press seal from the bulb;

terminal prongs (10, 30) for connection of the lamp to an external current supply;

electrical connections between said current supply leads and the terminal prongs;

a base cup (7, 27) having a sleeve portion, open at one end, facing the bulb, and a bottom wall (*7a*);

a metal holding cap(5,25) attached to the bulb and fitted on the base cup to secure the bulb to the base cup;

openings (8) formed in the bottom wall (*7a*) of the base cup for passage of the current leads (3, 23) therethrough, and comprising, in accordance with the invention, means for retaining the electrical terminal prongs (10, 30) and protecting the electrical connections between the current leads (3, 23) and the terminal prongs including an attachment element (12, 32) of insulating material having a wall portion (*12a, 32a*) formed with openings, the terminal prongs (10, 30) being passed through said openings in the wall portion, said wall portion (*12a, 32a*) being spaced from the bottom wall (*7a*) of the base cup (7, 27) defining therewith a chamber (13, 33); and wherein the electrical connections between the terminal prongs (10, 30) and the current leads (3, 23) are located in said chamber (13, 33).

2. Lamp according to claim 1, wherein the opening is dimensioned to be only very slightly larger than the current leads (3, 23) passing therethrough.

3. Lamp according to claim 2, wherein the openings (8) at the side facing the bulb (1, 21) are enlarged to form a funnel-shaped entrance portion to facilitate threading the current lead through the openings.

4. Lamp according to claim 2, further including a collar (42) formed at the end portions of the respective walls surrounding the openings, said collar (42) being melted to tightly surround, grip and seal the respective current leads passing through the opening.

5. Lamp according to claim 2, further including a resin filling sealing the respective current leads passing through the openings.

6. Lamp according to claim 5, wherein the resin filling comprises a silicone resin.

7. Lamp according to claim 1, including attachment means engaging the terminal prongs (10, 30) formed on at least one of: the attachment element; the base cup.

8. Lamp according to claim 7, wherein the bottom wall (*7a*) of the base cup (7) is formed with blind slots (11) into which the terminal prongs (10) are fitted, to form said attachment means.

9. Lamp according to claim 7, wherein the attachment means comprises projecting elements (28, 41) projecting from the attachment element; and notches or grooves fitting around said projecting elements.

10. Lamp according to claim 1, wherein the base cup (7, 27) comprises high temperature resistant plastic material.

11. Lamp according to claim 1, wherein the attachment element (12, 32) comprises plastic material.

12. Lamp according to claim 10, wherein the attachment element comprises plastic material of lesser temperature resistance than the base cup (7, 27); and means irremovably connecting the attachment element and the base cup.

13. Lamp according to claim 12, wherein the irremovable connection means comprises a rivet connection (14) formed by deformation of the plastic material of at least one of: said base cup; said attachment element.

14. Lamp according to claim 12, wherein said connection of the base cup and the attachment element comprises at least one of: ultrasonic rivet connection; interengaging connection by ultrasonic heating.

15. Lamp according to claim 1, further including a protective sleeve (15, 45) secured to the attachment element (12, 32) and extending in the direction of free ends of the terminal prongs (10, 30) to protect the terminal prongs.

16. Lamp according to claim 1, wherein said metal holding cap (5, 25) comprises angled-over legs (6, 26) irremovably connected to the base cup (7, 27).

17. Lamp according to claim 16, wherein the holding cap (5, 25) and the base cup (7, 27) are connected by deformation of the base cup by high-frequency or ultrasonic heating, to form said connection means.

18. Lamp according to claim 17, wherein the connection means comprises an interengaging projection-and-recess connection formed, respectively, on said legs (6, 26) of the holding caps and the base cup (7, 27), including a ridge or rib formed on said legs, and apertures formed on said legs, around which rib and through which apertures material from the base cup has been flowed or melted by heating or deformation thereof.

19. Lamp according to claim 1, wherein said incandescent lamp comprises a halogen incandescent lamp.

20. The combination of an automotive headlight reflector with the lamp of claim 19, wherein the base cup (7, 27) comprises high temperature resistant plastic material;

the attachment element (12, 32) comprises plastic material; and said attachment element and the base cup are irremovably attached together; and a protective coating of a flowable resin material surrounding the connections between the terminal prongs (IO, 30) and the current leads (3, 23), said current leads (3, 23) being sealed through said openings formed in the bottom wall (*7a*) of the base cup.

21. Lamp according to claim 1, wherein said terminal prongs (10, 30) and the current leads (3, 23) are welded together to form said electrical connection; and an environmentally protective coating surrounding said weld connection and positioned within said chamber 13, 33).

* * * * *